US007157138B2

(12) United States Patent
Ohnishi et al.

(10) Patent No.: US 7,157,138 B2
(45) Date of Patent: Jan. 2, 2007

(54) FIBER BOARD

(75) Inventors: Kenji Ohnishi, Osaka (JP); Masayuki Okuzawa, Sanda (JP); Yuzo Okudaira, Hyogo (JP); Hideyuki Ando, Suita (JP); Kazunori Umeoka, Nara (JP); Ryo Sugawara, Nishinomiya (JP); Bunkai Ryu, Kadoma (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 10/757,417

(22) Filed: Jan. 15, 2004

(65) Prior Publication Data

US 2004/0224140 A1 Nov. 11, 2004

(30) Foreign Application Priority Data

Mar. 31, 2003 (JP) ..... 2003-096844
Mar. 31, 2003 (JP) ..... 2003-096846

(51) Int. Cl.
*D21J 1/00* (2006.01)

(52) U.S. Cl. ..... 428/292.4; 428/297.4; 428/364; 428/401; 428/317.1

(58) Field of Classification Search ..... 428/401, 428/297.4, 292.1, 364, 317.1, 311.71, 311.91, 428/298.1, 298.7, 300.1, 375, 300.7, 378; 156/325, 326, 335
See application file for complete search history.

(56) References Cited

U.S. PATENT DOCUMENTS 5,728,269 A 3/1998 Kohno et al.
6,197,414 B1 * 3/2001 Kawai et al. ..... 428/297.4

FOREIGN PATENT DOCUMENTS

JP 6-285819 A 10/1994
JP 2000-263519 A 9/2000
JP 2002-248610 A 9/2002
WO WO 02/088465 A1 11/2002

* cited by examiner

*Primary Examiner*—Merrick Dixon
(74) *Attorney, Agent, or Firm*—Birch, Stewart, Kolasch & Birch, LLP

(57) ABSTRACT

A fiber board, comprising:

kenaf fibers having an average length of 10 to 200 mm and an average diameter of 10 to 300 μm, and a thermosetting adhesive agent, the fiber board having a density of 600 to 900 kg/m$^3$, being excellent in strength and moisture permeability.

7 Claims, 5 Drawing Sheets

FIBER BOARD

This Non-provisional application claims priority under 35 U.S.C. § 119(a) on Patent Application No(s). 2003-096844 and 2003-096846 filed in Japan on Mar. 31, 2003, the entire contents of which are hereby incorporated by reference.

BACKGROUND OF THE INVENTION

1. Field of the Invention

The present invention relates to a fiber board that is manufactured by using kenaf fibers as its raw material.

2. Description of the Related Art

Conventionally, with respect to a wall material used for forming walls of a house and the like, a fiber board having moisture permeability (air permeability) has been used. In general, since the water vapor pressure inside a room is higher than the water vapor pressure outside the room, when such a moisture permeable fiber board is used for forming walls, moisture (water content) inside a room can be transported outside the room through the walls.

With respect to the moisture permeable fiber board as described above, conventionally, molded boards mainly composed of natural plant fibers, such as oil palm fibers and jute fibers, have been known (see, for example, JP-A No. 6-285819 (paragraph number [0011] and the like). In the case when, with respect to these molded boards, rigidity is desired in addition to air permeability, these properties can be achieved by properly setting the kind and the rate of use of its adhesive agent.

DISCLOSURE OF INVENTION

In the above-mentioned molded board, however, the rigidity and strength, obtained by properly setting the kind and the like of the adhesive agent, are limited. Even when the rigidity and strength are increased beyond this limitation, this arrangement no longer maintains sufficient moisture permeability in most cases, resulting in the following problems.

In other words, when a wall is formed by using a molded board that is insufficient in moisture permeability, this wall of course makes it difficult for moisture in the room to permeate into the wall, and moisture, once permeated into the wall, is hardly released outside the room, and stays in the wall. In such a case, even when the strength of the wall has been increased to a certain level, dew condensation soon occurs inside the wall, with the result that pillars and heat-insulating materials inside the wall tend to become rotten due to the dew condensation, causing a reduction in the strength of the wall itself. In contrast, a molded board having sufficient moisture permeability originally tends to fail to maintain sufficient strength, and is not applicable as the wall material.

As described above, in the case of the molded board mainly composed of natural plant fibers such as oil palm fibers, it is difficult to satisfy both of moisture permeability and strength required for wall materials for forming walls of a house and the like, and it is also difficult to utilize the above-mentioned molded board as construction materials, such as floor materials, ceiling materials and grounding materials, that require moisture permeability and strength in the same manner as the wall materials.

SUMMARY OF THE INVENTION

The present invention has been made to solve the above-mentioned problems, and its objective is to provide a fiber board which has sufficiently high strength with high moisture permeability.

The present invention relates to a fiber board, comprising:

kenaf fibers having an average length of 10 to 200 mm and an average diameter of 10 to 300 μm, and a thermosetting adhesive agent, the fiber board having a density of 600 to 900 kg/m$^3$, being excellent in strength and moisture permeability

BRIEF DESCRIPTION OF THE DRAWINGS

FIG. 1(*b*) is a schematic cross-sectional view that shows a kenaf fiber in which a monomer component of a phenolic resin is permeated.

FIG. 1(*c*) is a schematic cross-sectional view that shows a kenaf fiber to which a polymer component of the phenol resin has adhered.

FIG. 4(*b*) is a graph that shows the relationship between the pH of the phenolic resin adhesive agent and the expansion coefficient in thickness of the fiber board.

FIG. 5(*b*) is a graph that shows the relationship between the content of free formaldehyde in the phenolic resin adhesive agent and the amount of diffusion of formaldehyde from the fiber board.

DETAILED DESCRIPTION OF THE INVENTION

Figure 1A:
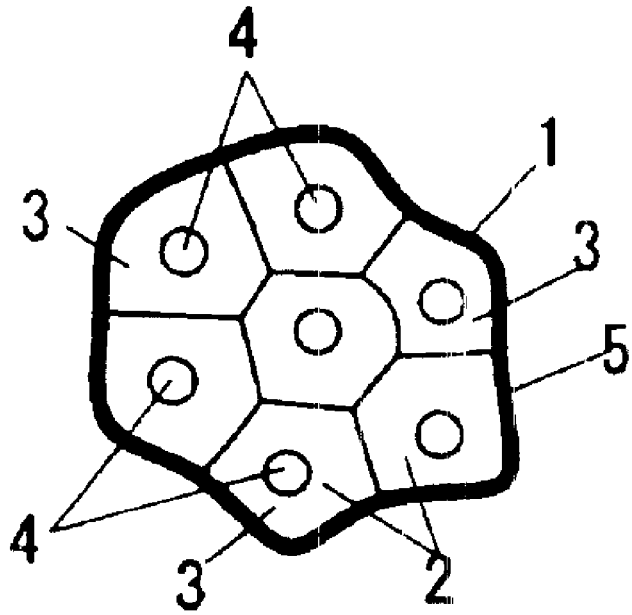
FIG. 1(*a*) is a schematic cross-sectional view that shows a kenaf fiber.

A fiber board in accordance with the first invention is characterized in which a fiber board is manufactured by bonding kenaf fibers obtained by fiber-opening kenaf with a thermosetting adhesive agent, and with respect to the kenaf fibers, those fibers having an average length of 10 to 200 mm and an average diameter of 10 to 300 μm are used, and a fiber mat formed by aggregating these kenaf fibers is impregnated with a thermosetting adhesive agent so that the fiber board is formed so as to have a density of 600 to 900 kg/m$^3$.

A second invention is characterized in that in the first invention the thermosetting adhesive agent is a phenolic resin having an average molecular weight of 400 to 700, which contains 10 to 40% by weight of a monomer and 60 to 90% by weight of a polymer having a molecular weight of 200 to 2,000.

A third invention is characterized in that in the first invention or the second invention the pH of the thermosetting adhesive agent is set to not more than 10.

A fourth invention is characterized in that in any one of the inventions 1 to 3 with respect to the kenaf fibers, those fibers having a standard deviation in length of not more than 20 mm and a standard deviation in diameter of not more than 50 μm are used.

EFFECT OF THE INVENTION

The present invention makes it possible to provide sufficiently high strength with high moisture permeability so that the above-mentioned fiber board can be utilized as a wall material for forming walls in a house and the like, and also utilized as construction materials, such as floor materials, ceiling materials and grounding materials, that require high moisture permeability and strength in the same manner as the wall materials.

In accordance with the second invention, the monomer contained at 10 to 40% by weight mainly permeate into the kenaf fibers, while the polymer, contained at 60 to 90% by weight with a molecular weight of 200 to 2,000, is poor in the permeability into the kenaf fibers, and allowed to mainly adhere to the surface of the kenaf fiber. The component that has permeated to the inside of the kenaf fiber is cured so that-it becomes possible to suppress moisture absorption into the kenaf fiber, and consequently to suppress swelling and deformation of the kenaf fiber due to moisture absorption; thus, the dimension stability of the fiber board is improved and the component adhering to the surface of the kenaf fiber is cured so that the kenaf fibers are mutually bonded to and combined with one another firmly, and the peel strength in the fiber board is increased. Consequently, it is possible to provide a fiber board having superior dimension stability with high peel strength.

In accordance with the third invention, it is possible to obtain a fiber board having high peel strength with a low expansion coefficient in the thickness.

In accordance with the fourth invention, it is possible to obtain a fiber board having stable characteristics such as moisture permeability and strength.

The following description will discuss the best mode for carrying out the present invention.

A fiber board in accordance with the present invention is manufactured by bonding kenaf fibers that are obtained by fiber-opening kenaf (annual plant belong to Malvaceae) with a thermosetting adhesive agent.

Figure 1B:
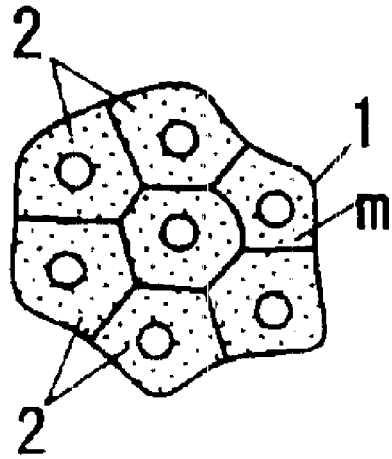
Figure 1C:
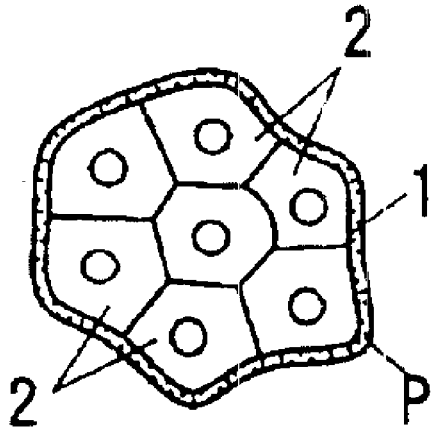

The kenaf fibers are obtained by subjecting long fiber bundles (with a width of 1 to 2 cm and a length of 2 to 4 m) obtained from the bast portion of the kenaf stem to mechanical fiber-opening processes. The fiber-opening processes are carried out until the kenaf fibers come to have an average length of 10 to 200 mm, preferably 15 to 80 mm, with an average fiber diameter of 10 to 300 μm, preferably 70 to 150 μm. Upon manufacturing the fiber board, the present invention uses kenaf fibers that have been subjected to such fiber-opening processes. FIG. 1(*a*) shows a schematic drawing that shows a cross-section of the kenaf fiber 1 observed under microscope, and a single kenaf fiber 1 is composed of a number of monofibers 2, each having a diameter of 10 to 30 μm, combined with one another, and the cell wall 3 of each monofiber 2 forms a conduit 4 in the center. Reference numeral 5 shows the surface of the fiber.

In the case when the average length of the kenaf fiber is shorter than the above-mentioned range, the interlocking among the kenaf fibers becomes insufficient, failing to increase the strength of the fiber board sufficiently. In contrast, in the case when the average length of the kenaf fiber is longer than the above-mentioned range, it becomes difficult to form a fiber mat, which will be described later, with a uniform structure; consequently, the density of the fiber board obtained through a molding process under heat and pressure tends to deviate greatly, causing defective portions in the strength. In the case when the average diameter of the kenaf fibers is smaller than the above-mentioned range, with respect to the strength, the kenaf fibers come to have more contact points, and are interlocked with one another more firmly so that, although the strength of the fiber board is increased, spaces between the kenaf fibers become smaller to cause degradation in the moisture permeability. In contrast, in the case when the average diameter of the kenaf fibers is greater than the above-mentioned range, although a fiber board having high moisture permeability is obtained, the average diameter becomes too great in the same manner as the oil palm fibers, resulting in a reduction in the strength of the fiber board.

A fiber mat, formed by aggregating the above-mentioned kenaf fibers, is impregnated with a thermosetting adhesive agent so that a fiber board is manufactured. The following description discusses a specific example of the manufacturing method. The above-mentioned fiber mat is obtained through the steps of: laminating kenaf fibers that have been subjected to the fiber-opening process, and subjecting these to a needle punching process and the like, if necessary, so that the kenaf fibers are interlocked with one another. With respect to the thermosetting adhesive agent, although not particularly limited, for example, phenolic resin adhesive agents, urea resin adhesive agents, melamine resin adhesive agents, melamine-urea co-condensation resin adhesive agents and the like can be used.

The fiber mat, obtained as described above, is immersed in a thermosetting adhesive agent so that the fiber mat is impregnated with the thermosetting adhesive agent. Then, the fiber mat, impregnated with the thermosetting adhesive agent, is made to pass through squeezing rollers so that the amount of adhesion of the thermosetting adhesive agent is adjusted to a predetermined range. The amount of adhesion of the thermosetting adhesive agent to the fiber mat is preferably adjusted in a range of 5 to 40% by weight, more preferably 15 to 30% by weight, on a solid-component basis based upon conversion to resin components. When the amount is smaller than 15% by weight, in particular, when the amount is smaller than 5% by weight, the peel strength of the resulting fiber board deteriorates, and in contrast, when it is greater than 30% by weight, in particular, greater than 40% by weight, the anti-impact property tends to deteriorate in the resulting fiber board. Here, prior to impregnation with the thermosetting adhesive agent, the fiber mat may be dried so as to adjust the moisture content of the fiber mat to not more than 25% by weight. The lower limit value of the moisture content of the fiber mat is not particularly limited; however, it is not necessary to reduce the moisture content to not more than 5% by weight. After having been dried to a reduced moisture content, the fiber mat is impregnated with the thermosetting adhesive agent so that the resin component is allowed to efficiently permeate into the kenaf fiber; thus, it becomes possible to obtain a fiber board with high dimension stability.

After the fiber mat has been impregnated with the thermosetting resin as described above, it is dried so as to be adjusted to a predetermined moisture content. The drying process is carried out by sending a normal-temperature air flow or a hot air flow to the fiber mat, or the fiber mat is directed to a heating furnace and heated. The drying process is preferably carried out to reduce the moisture content in the fiber mat to not more than 15% by weight. Thereafter, the fiber mat is molded by applying heat and pressure thereto so that the thermosetting adhesive agent is cured to prepare a fiber board. Although not particularly limited, the conditions of the molding process under heat and pressure are preferably set in a temperature range of 120 to 190° C. within a pressure range of 1 to 4 MPa, and with respect to the processing time, it is appropriately set depending on the board thickness and the heating temperature.

In the present invention, the density of the fiber board obtained as described above is set from 600 to 900 kg/m$^3$, preferably from 700 to 850 kg/m$^3$. The setting of such a density is achieved by adjusting the content of the thermosetting adhesive agent upon forming the fiber board, by adjusting the face weight (weight per unit area) of the fiber mat, or the like. When the density of the fiber board is smaller than the above-mentioned range, the rate of voids in the fiber board increases, with the result that the moisture permeation resistance is lowered to increase the moisture permeability; in contrast, interlocking among kenaf fibers fails to sufficiently devote to an increase in the strength of the fiber board. Since the fiber board of this type is poor in strength although it has sufficient moisture permeability, it is not applicable to wall materials and the like. In contrast, when the density of the fiber board is greater than the above-mentioned range, the rate of voids in the fiber board decreases so that interlocking among kenaf fibers devotes to an increase in the strength of the fiber board; however, the moisture permeation resistance increases, causing a reduction in the moisture permeability. Since the fiber board of this type is insufficient in the permeability although the strength is high, and since it tends to cause dew condensation, it is not applicable to wall materials and the like. Here, since oil palm fibers are thick in fiber diameter, it is not possible to obtain boards that satisfy both of moisture permeability and strength by using these. With respect to the application as floor materials, those fibers, such as oil palm fibers, that are thick in diameter fail to provide boards that satisfy a sufficient surface hardness required for caster endurance.

As described above, in the fiber board of the present invention, a fiber mat formed by aggregating desired kenaf fibers is impregnated with a thermosetting adhesive agent so that the board is formed so as to have a density of 600 to 900 kg/m$^3$. Therefore, it becomes possible to sufficiently increase the strength while maintaining high moisture permeability. For this reason, the above-mentioned fiber board can be used as wall materials for forming walls in a house and the like, and also utilized as construction materials, such as floor materials, ceiling materials and grounding materials, that require high moisture permeability and strength in the same manner as the wall materials.

In particular, the fiber board having a density in a range of 700 to 850 kg/M$^3$ is allowed to have higher strength as compared with fiber boards having a density that is smaller than 700 kg/m$^3$, and is also allowed to have higher moisture permeability as compared with fiber boards having a density that is greater than 850 kg/M$^3$; thus, it becomes possible to further maintain good balance between the moisture permeability and strength.

With respect to the kenaf fibers in the present invention, those fibers having a standard deviation in length of not more than 20 mm and a standard deviation in diameter of not more than 50 μm are preferably used. When kenaf fibers having greater deviations in length and kenaf fibers having greater deviations in fiber diameter are used, these fibers fail to provide stable characteristics in the above-mentioned moisture permeability, strength and the like. In contrast, those kenaf fibers having a standard deviation in length of not more than 20 mm and a standard deviation in diameter of not more than 50 μm are less susceptible to deviations in the fiber length and the fiber diameter so that it becomes possible to easily provide fiber boards having stable characteristics such as moisture permeability and strength. Of course, the smaller the standard deviations in the length and diameter of the kenaf fibers, the better.

Figure 3A:
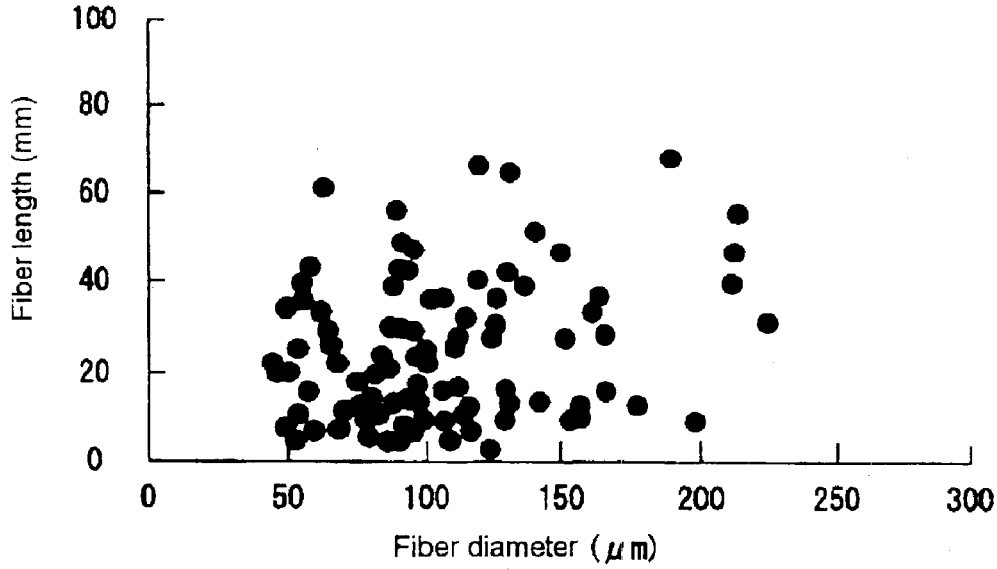
FIG. 3 is a graph that shows the relationship between the fiber diameter and the fiber length of a kenaf fiber.
Figure 3B:
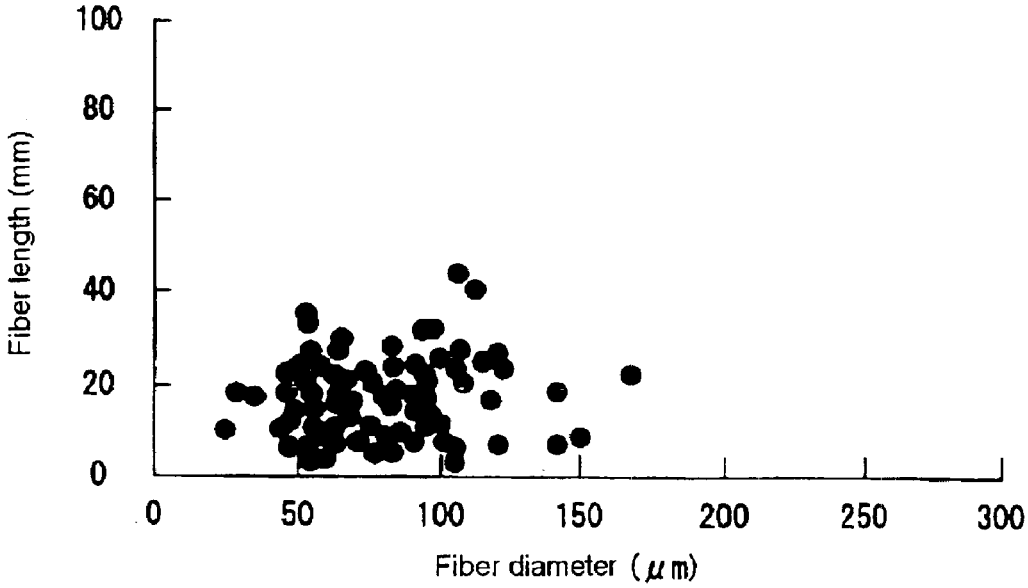

FIGS. 3(*a*) and 3(*b*) show graphs that indicate the relationship between fiber diameter and length when fiber opening processes of kenaf long fiber bundles and fiber-mat forming processes are carried out by using two kinds of devices, and (a) and (b) in Table 1 show data obtained by measuring the fiber diameter and length of these kenaf fibers. These kenaf fibers have a standard deviation in length of not more than 20 mm and a standard deviation in diameter of not more than 50 μm, and are preferably used in the present invention.

TABLE 1

| | | | |
|---|---|---|---|
| | (a) | | |
| Average diameter (μm) | 100 | Average length (mm) | 25 |
| Maximum | 224 | Maximum | 68 |
| Minimum | 44 | Minimum | 3 |
| Standard deviation | 41 | Standard deviation | 16 |
| | (b) | | |
| Average diameter (μm) | 80 | Average length (μm) | 16 |
| Maximum | 171 | Maximum | 45 |
| Minimum | 25 | Minimum | 3 |
| Standard deviation | 27 | Standard deviation | 9 |

In the present invention, with respect to the thermosetting adhesive agent to be used for bonding kenaf fibers, various adhesive agents as described above may be used, and among these phenolic resin adhesive agents are preferably used. Among phenolic resins, water-soluble resol-type phenolic resins are preferably used, and the resol-type phenolic resin is prepared in the following manner. In other words, distilled phenol, a formaldehyde aqueous solution and an alkali catalyst are weighed, and loaded into a reaction container, and this is stirred while being heated in an oil bath or the like to undergo a reaction, and to this is added an appropriate amount of sulfuric acid to adjust the pH thereof so that an excessive amount of alkali catalyst is neutralized and precipitated. Then, this is distilled and dehydrated while reducing the pressure by using an aspirator so that a phenolic resin aqueous solution having a weight ratio of non-volatile components (resin components) of approximately 50% is obtained, and this is used as an adhesive agent.

Figure 2:
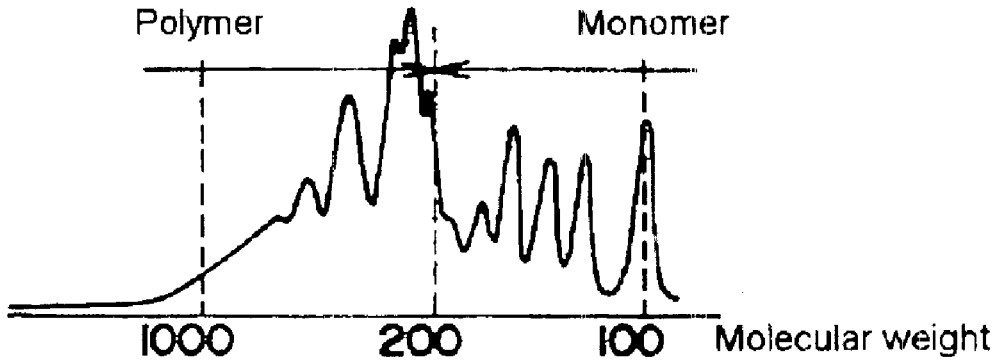
FIG. 2 is a graph that shows one example of a molecular weight distribution of the phenolic resin.

With respect to the alkali catalyst, examples thereof include sodium hydroxide, calcium hydroxide, barium hydroxide, ammonia, amines and the like, and with respect to the reaction conditions, in general, the temperature range is set from 60 to 95° C., and the reaction time is set approximately from several tens of minutes to 2 hours. Here, the resol-type phenolic resin is prepared as a mixture of a monomer, such as phenol, monomethylol phenol, dimethylol phenol and trimethylol phenol, and a polymer in which two or more of these monomers are bonded. In this manner, the phenolic resin contains a monomer having a molecular weight in a range of not less than 90 to less than 200 and a polymer having a molecular weight in a range of not less than 200 to not more than 2,000, and the molecular weight distribution of the phenolic resin is, for example, given in FIG. 2. Upon preparing the above-mentioned phenolic resin, phenolic resins having different molecular weights with different viscosities are obtained by controlling the reaction conditions and molar ratio of phenol and aldehyde as well as by selecting the kind and amount of an alkali catalyst; thus, the molecular weight distribution of the phenolic resin is freely controlled.

In the present invention, with respect to the phenolic resin adhesive agent, a phenolic resin whose resin components are adjusted to contain 10 to 40% by weight, preferably 20 to 40% by weight of a monomer having a molecular weight of 90 to 200, preferably 90 to 190 and 60 to 90% by weight, preferably 60 to 80% by weight of a polymer having a molecular weight of 200 to 2000 (total of two components: 100% by weight), with an average molecular weight (weight average molecular weight: Mw) being set in a range of 400 to 700, is preferably used. The monomer which has a small molecular size, exerts high permeability into the kenaf fiber 1 so that as shown in FIG. 1(*b*), the monomer m is allowed to mainly permeate into the kenaf fiber 1, while the polymer, which has a great molecular size, has poor permeability into the kenaf fiber 1 so that as shown in FIG. 1(*c*) the polymer p is allowed to mainly adhere to the surface of the kenaf fiber 1. Therefore, when the phenolic resin adhesive agent is cured in a molding process, the monomer is cured inside the kenaf fiber 1 so that it suppresses absorption of moisture into the kenaf fiber 1 even when the fiber board absorbs water; thus, it is possible to suppress swelling and deformation of the kenaf fiber 1, and consequently to improve the dimension stability of the fiber board. The polymer is cured on the surface of the kenaf fiber 1 so that the kenaf fibers 1 are mutually bonded to and combined with one another firmly; thus, it becomes possible to increase the peel strength of the fiber board. In this manner, it becomes possible to provide a fiber board that is superior in dimension stability and also has high peel strength.

In the case of a content of the monomer of less than 10% by weight in the phenolic resin with a content of the polymer exceeding 90% by weight, the amount of resin components that permeate into the kenaf fiber 1 becomes smaller, failing to provide sufficient dimension stability. In contrast, in the case of a content of the monomer exceeding 40% by weight, with a content of the polymer being less than 60% by weight, the amount of resin components adhering to the surface of the kenaf fiber 1 becomes smaller, the peel strength of the fiber board becomes insufficient. When the average molecular weight of the phenolic resin is less than 400, the amount of resin components adhering to the surface of the kenaf fiber 1 becomes smaller, resulting in insufficient peel strength in the fiber board, and when the average molecular weight of the phenolic resin exceeds 700, the amount of resin components that permeate into the kenaf fiber 1 becomes smaller, failing to provide sufficient dimension stability. Therefore, in order to satisfy both of the characteristics of dimension stability and peel strength, a phenolic resin which has a monomer and a polymer whose contents and average molecular weights are set within the above-mentioned ranges needs to be used.

Figure 4A:
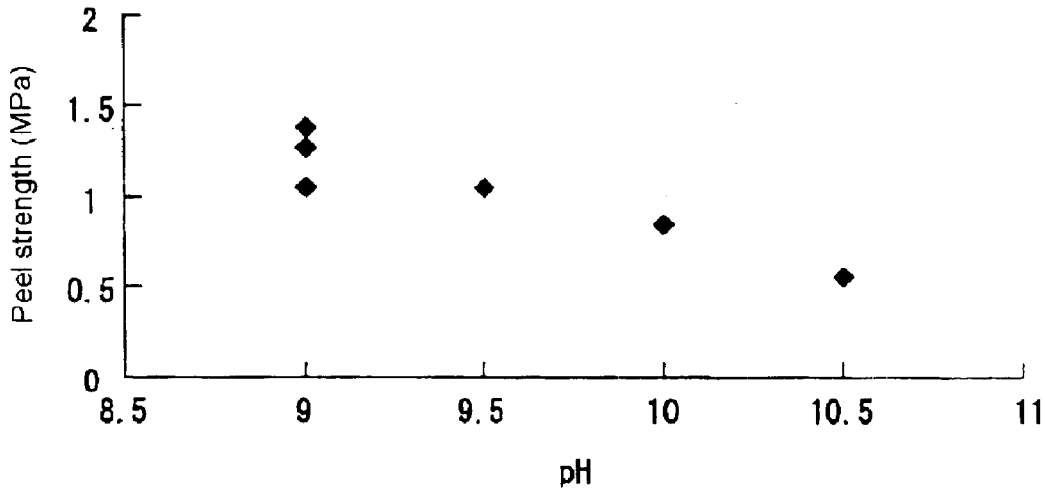
FIG. 4(*a*) is a graph that shows the relationship between the pH of a phenolic resin adhesive agent and the peel strength of a fiber board.
Figure 4B:
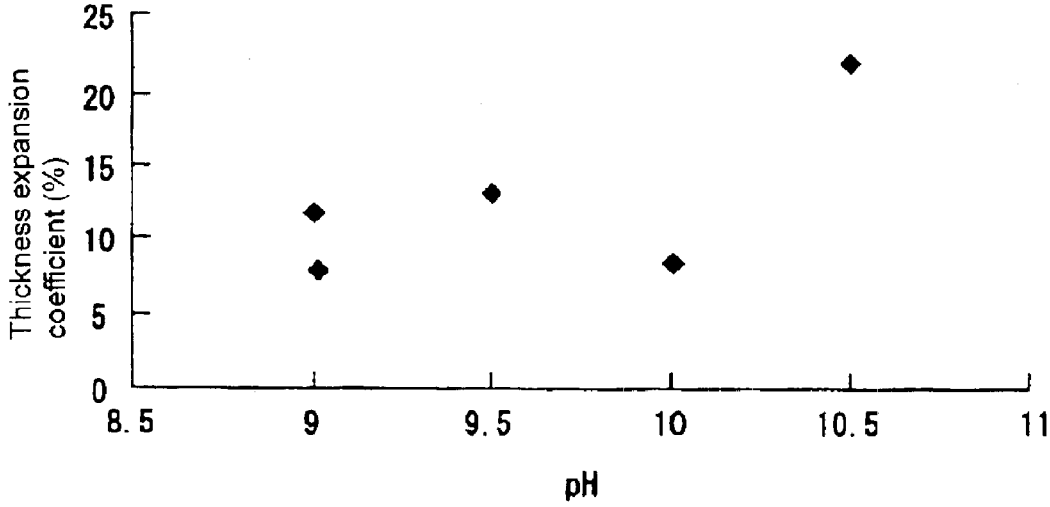

With respect to the thermosetting adhesive agent for bonding kenaf fibers, those having a pH value of not more than 10 are preferably used. Table 2 and FIG. 4(*a*) show the relationship between the pH of the phenolic resin adhesive agent and the peel strength of the fiber board, and Table 2 and FIG. 4(*b*) show the relationship between the pH of the phenolic resin adhesive agent and the expansion coefficient in thickness of the fiber board. These show that by using a thermosetting adhesive agent having a pH value of not more than 10 as the thermosetting adhesive agent, it becomes possible to obtain a fiber board that has high peel strength with a small expansion coefficient in thickness. Although not particularly limited, the lower limit of the pH is practically set to approximately pH 8. Here, the expansion coefficient in thickness is measured based upon a method standardized by JIS A 5905 (fiber board).

TABLE 2

| PH | Peel strength (MPa) | Expansion coefficient in thickness (%) |
|---|---|---|
| 9.0 | 1.37 | 7.8 |
| | 1.27 | 11.8 |
| | 1.05 | 8.0 |
| 9.5 | 1.04 | 13.0 |
| 10.0 | 0.83 | 8.3 |
| 10.5 | 0.54 | 22.0 |

With respect to the thermosetting adhesive agent for bonding kenaf fibers, those having a free phenol content of not more than 3% by weight are preferably used, and those having a free formaldehyde content of not more than 0.07% by weight are also preferably used.

Figure 5A:
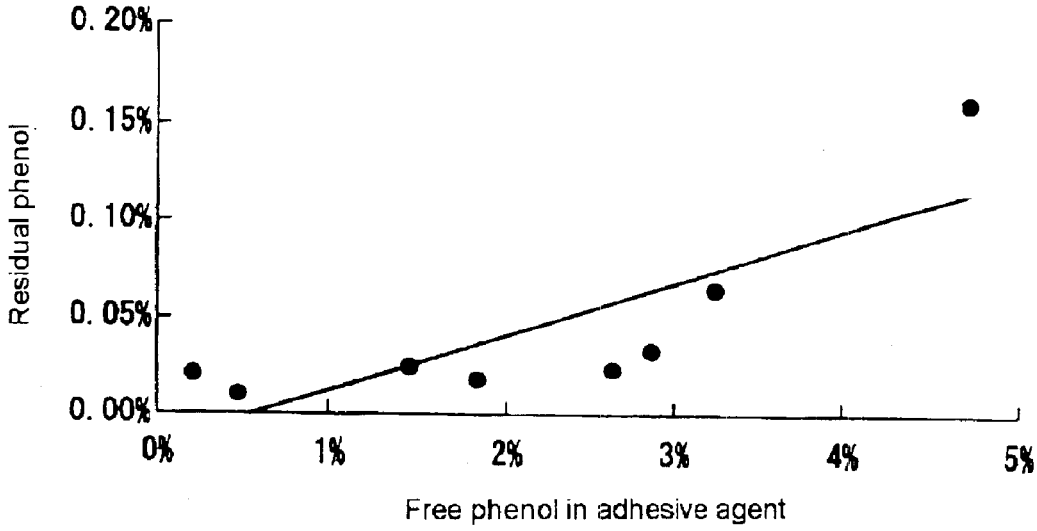
FIG. 5(*a*) is a graph that shows the relationship between the content of free phenol in the phenolic resin adhesive agent and the residual phenol in the fiber board.
Figure 5B:
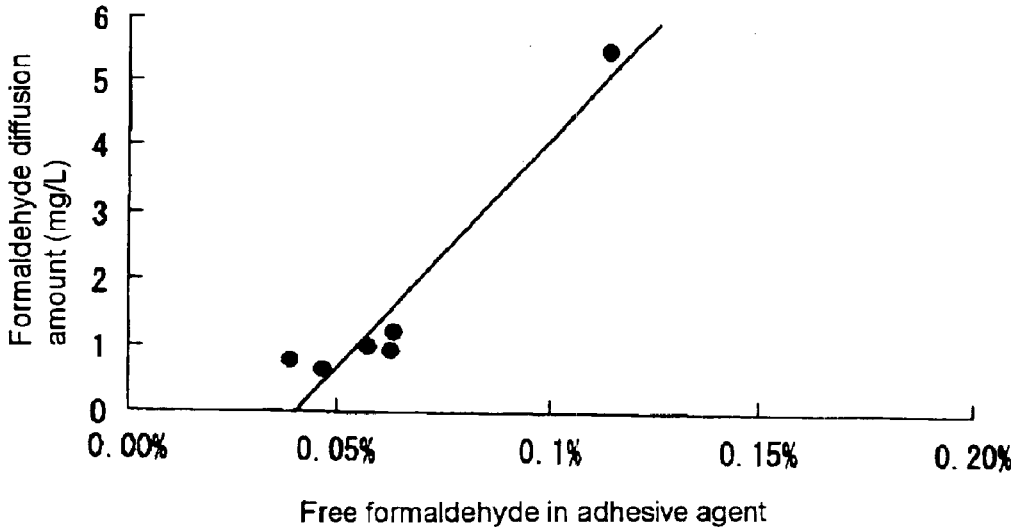

The phenolic resin can be synthesized by using phenol and formaldehyde as raw materials, and during the synthesizing process, a thermosetting adhesive agent made from a phenolic resin having a low free phenol content is obtained by controlling factors such as the reaction time, reaction temperature and reaction speed. FIG. 5(*a*) shows the relationship between the content of free phenol in the thermosetting adhesive agent and the residual rate of phenol in a fiber board manufactured by using this thermosetting adhesive agent. When the content of free phenol in the thermosetting adhesive agent is not more than 3% by weight, the amount of residual phenol in the fiber board is small so that it is possible to reduce the residual phenol that is a main cause of offensive odor generated from the molded fiber board. Therefore, it becomes possible to reduce odor while maintaining the physical properties of the board, without the necessity of particularly carrying out processes and the like after the molding process of the fiber board. The smaller the content of free phenol in the thermosetting adhesive agent, the better, and it is ideal to set the value to 0%.

In the same manner, by controlling the factors such as the reaction time, reaction temperature and reaction speed, it is possible to obtain a thermosetting adhesive agent made from a phenolic resin having a low content of free formaldehyde. FIG. 5(*b*) also shows the relationship between the content of free formaldehyde in the thermosetting adhesive agent and the diffusion amount of formaldehyde from a fiber board manufactured by using this thermosetting adhesive agent. When the content of free formaldehyde in the thermosetting adhesive agent is not more than 0.07% by weight, the radiation amount of formaldehyde from the fiber board is small so that it is possible to reduce the diffusion of formaldehyde that forms a major cause of sickhouse symptoms. Therefore, it becomes possible to achieve a low formaldehyde level while maintaining the physical properties of the board, without the necessity of particularly carrying out processes and the like after the molding process of the fiber board. The smaller the content of free formaldehyde in the thermosetting adhesive agent, the better, and it is ideal to set the value to 0%.

EXAMPLES

The following description will discuss the present invention in detail by means of examples. Here, the measurements of the molecular weight were carried out by using a GPC measuring device "HLC 802A" made by Tosoh Corporation through a gel permeation chromatograph (GPC) method. In this case, an adhesive agent solution to be used in the molecular-weight measurements was dissolved in a THF solution, and then filtered through a filter to be used for the analysis. The molecular weight calculations were carried out based upon polyethylene conversion, and the weight-average value was used as the molecular weight of the adhesive agent.

Example 1

Long fiber bundles (width: 1 to 2 cm, length: 2 to 4 m), obtained from bast portions of kenaf stems were mechanically defibrated so that kenaf fibers having an average length of 25 mm and an average diameter of 100 μm (standard deviation of fiber length: 16 mm, standard deviation of fiber diameter: 41 μm) were obtained. These kenaf fibers were laminated and subjected to a needle punching process to obtain a fiber mat. This fiber mat was immersed in a phenolic resin adhesive agent, and then squeezed through squeezing rollers so that the content of the phenol resin adhesive agent was adjusted to 25% by mass. With respect to the phenolic resin adhesive agent, a resol-type phenolic resin adhesive agent (resin component ratio: 50% by weight, pH 9.0, free phenol: 1.4% by weight, free formaldehyde: 0.06% by weight), which contains a monomer having a weight average molecular weight of 584 with a range of molecular weight of 90 to 190 and a polymer having a range of molecular weight of 200 to 2,000 at a weight ratio of 30:70, was used.

The fiber mat containing the phenolic resin adhesive agent was dried at 80° C. so that the moisture content thereof was set to 10% by weight. Then, this fiber mat was molded under heat and pressure under conditions of 170° C., 3 MPa and 4 minutes to obtain a kenaf fiber board having a thickness of 4 mm. This kenaf fiber board had a density of 600 kg/m$^3$.

Example 2

The similar processes to example 1 were carried out except that the density of the kenaf fiber board was set to 750 kg/m$^3$.

Example 3

The similar processes to example 1 were carried out except that the density of the kenaf fiber board was set to 800 kg/m$^3$.

Example 4

The similar processes to example 1 were carried out except that the density of the kenaf fiber board was set to 850 kg/m $^3$.

Example 5

The similar processes to example 1 were carried out except that the density of the kenaf fiber board was set to 900 kg/M$^3$.

Comparative Example 1

The similar processes to example 1 were carried out except that the density of the kenaf fiber board was set to 500 kg/m$^3$.

Comparative Example 2

The similar processes to example 1 were carried out except that the density of the kenaf fiber board was set to 1000 kg/m$^3$.

Comparative Example 3

A commercial plywood (lauan plywood) having a thickness of 4 mm and a density of 550 kg/m$^3$ was used.

By using the above-mentioned kenaf fiber boards of examples 1 to 5 and comparative examples 1 and 2 as well as plywood of comparative example 3 as samples, the moisture permeation resistance and bending strength were measured. Table 3 shows the results.

The measurements of the moisture permeation resistance were carried out based upon a cup method shown in JIS A 1324 (moisture permeability measuring method for construction materials). In other words, calcium chloride was put into a moisture permeable cup having a diameter of 30 cm, and this cup was sealed with each sample so that the sample was attached thereto. The cups to which the samples had been attached were put into a thermo-hygrostat that was set to a temperature of 23° C. with relative humidity of 50%, and the cups were taken out thereof with predetermined time intervals so that a mass increase of the cup was measured to find the moisture permeation amount of the sample. The moisture permeation resistance was calculated from the following equation.

$$Zp=(P_1-P_2)\times A/G$$

In this equation, Zp: moisture permeation resistance [(m$^2$·s·Pa)/ng] {(m$^2$·h·mmHg)/g}, G: moisture permeation amount (ng/s) {g/h}, A: moisture permeation area (0.0625 m$^2$), $P_1$: water vapor pressure of air in the thermo-hygrostat (Pa) {mmHg}, $P_2$: water vapor pressure of air inside the moisture permeable cup (0 Pa){0 mmHg}.

The bending strength was measured through bending strength tests based upon JIS A 5905 (fiber board).

TABLE 3

| | Kinds of boards | Board density kg/m$^3$ | Moisture permeation resistance m$^2$ · h · mmHg/g | (m$^2$ · s · Pa/ng) | Bending strength MPa |
|---|---|---|---|---|---|
| Example 1 | Kenaf fiber board 4 mm in thickness | 600 | 0.42 | (882) | 48 |
| Example 2 | | 750 | 0.72 | (1512) | 65 |
| Example 3 | | 800 | 0.99 | (2079) | 88 |
| Example 4 | | 850 | 1.34 | (2814) | 110 |
| Example 5 | | 900 | 2.56 | (5376) | 120 |
| Comparative Example 1 | Kenaf fiber board 4 mm in thickness | 500 | 0.23 | (483) | 20 |
| Comparative Example 2 | | 1000 | 4.89 | (10269) | 150 |
| Comparative Example 3 | Plywood 4 mm in thickness | 550 | 2.79 | (5859) | 40 |

As indicated by Table 3, with respect to examples 1 to 5, the moisture permeation resistance is 5376 ($m^2 \cdot s \cdot Pa$)/ng at most, and the bending strength is 48 MPa at the minimum; thus, it is confirmed that any of the kenaf fiber boards of examples 1 to 5 have high moisture permeability and strength.

It is confirmed that, even when predetermined kenaf fibers are used, the density of lower than 600 $kg/m^3$ causes a serious reduction in the bending strength as indicated by the kenaf fiber board of comparative example 1, while the density exceeding 900 $kg/m^3$ causes a serious increase in the moisture permeation resistance as indicated by the kenaf fiber board of comparative example 2, failing to provide a well-balanced state between the moisture permeation resistance and the strength. In the case of commercial plywood of comparative example 3, it is confirmed that it is not possible to obtain preferable moisture permeation resistance and sufficient strength.

Example 6

Kenaf fibers having an average fiber length of 25 mm and an average fiber diameter of 100 μm (standard deviation of fiber length: 16 mm, standard deviation of fiber diameter: 41 μm) were allowed to aggregate to prepare a fiber mat having a mat face weight of 0.94 $g/cm^2$. The moisture content of this fiber mat was measured and found to be 25% by weight.

In the adhesive agent coating process, with respect to the phenolic resin adhesive agent, a resol-type phenolic resin adhesive agent (resin component ratio: 50% by weight, pH 9.0, free phenol: 1.4% by weight, free formaldehyde: 0.06% by weight), which contained a monomer having a weight average molecular weight of 498 with a range of molecular weight of 90 to 190 and a polymer having a range of molecular weight of 200 to 2,000 at a weight ratio of 40:60, was used, and this fiber mat was immersed in the phenolic resin adhesive agent for 10 seconds, and this was then squeezed through squeezing rollers so that the phenolic resin adhesive agent was allowed to adhere to the fiber mat with a content of the phenolic resin component being set to 25% by weight.

In the adhesive agent drying process, a dry air flow at 50° C. was directed to the fiber mat coated with the adhesive agent so that the moisture content in the fiber mat was set to 10% by weight, to dry the fiber mat.

In the molding process, three layers of the above-mentioned dried fiber mats were laminated, and molded under heat and pressure under conditions of a molding temperature of 170° C., a molding pressure of 3 MPa and a period of time of 3.5 minutes to obtain a kenaf fiber board having a thickness of 4 mm and a board density of 750 $kg/m^3$.

Example 7

The same processes as example 6 were carried out except that, in the adhesive agent coating process, with respect to the phenolic resin adhesive agent, a resol-type phenolic resin adhesive agent (resin component: 50% by weight, pH 9.0, free phenol: 1.4% by weight, free formaldehyde: 0.06% by weight), which contained a monomer having a weight average molecular weight of 560 with a range of molecular weight of 90 to 190 and a polymer having a range of molecular weight of 200 to 2,000 at a weight ratio of 30:70, was used; thus, a kenaf fiber board was prepared.

Example 8

The same processes as example 6 were carried out except that, in the adhesive agent coating process, with respect to the phenolic resin adhesive agent, a resol-type phenolic resin adhesive agent (resin component: 52% by weight, pH 9.0, free phenol: 1.4% by weight, free formaldehyde: 0.06% by weight), which contained a monomer having a weight average molecular weight of 640 with a range of molecular weight of 90 to 190 and a polymer having a range of molecular weight of 200 to 2,000 at a weight ratio of 20:80, was used; thus, a kenaf fiber board was prepared.

Example 9

A fiber mat was first dried in the fiber-mat drying process to have a moisture content of 13% by weight. The same processes as example 8 were carried out except that the fiber mat thus dried was used to prepare a kenaf fiber board.

Example 10

The same processes as example 6 were carried out except that, in the adhesive agent coating process, with respect to the phenolic resin adhesive agent, a resol-type phenolic resin adhesive agent (resin component: 47% by weight, pH 9.0, free phenol: 1.0% by weight, free formaldehyde: 0.05% by weight), which contained 100% of a polymer having a weight average molecular weight of 360 with a range of molecular weight of 200 to 650, was used; thus, a kenaf fiber board was prepared.

Example 11

The same processes as example 6 were carried out except that, in the adhesive agent coating process, with respect to the phenolic resin adhesive agent, a resol-type phenolic resin adhesive agent (resin component: 52% by weight, pH 9.0, free phenol: 1.0% by weight, free formaldehyde: 0.05% by weight), which contained 100% of a polymer having a weight average molecular weight of 605 with a range of molecular weight of 200 to 1,000, was used; thus, a kenaf fiber board was prepared.

Example 12

The same processes as example 6 were carried out except that, in the adhesive agent coating process, with respect to the phenolic resin adhesive agent, a resol-type phenolic resin adhesive agent (resin component: 53% by weight, pH 9.5, free phenol: 2.7% by weight, free formaldehyde: 0.06% by weight), which contained 100% of a polymer having a weight average molecular weight of 1,010 with a range of molecular weight of 200 to 2,000, was used; thus, a kenaf fiber board was prepared.

Example 13

The same processes as example 6 were carried out except that, in the adhesive agent coating process, with respect to the phenolic resin adhesive agent, a resol-type phenolic resin adhesive agent (resin component: 47% by weight, pH 9.0, free phenol: 1.0% by weight, free formaldehyde: 0.05% by weight), which contained a monomer having a weight average molecular weight of 450 with a range of molecular weight of 90 to 190 and a polymer having a range of molecular weight of 200 to 1000 at a weight ratio of 60:40, was used; thus, a kenaf fiber board was prepared.

Example 14

The same processes as example 6 were carried out except that, in the adhesive agent coating process, with respect to the phenolic resin adhesive agent, a resol-type phenolic resin adhesive agent (resin component: 52% by weight, pH 9.5, free phenol: 2.7% by weight, free formaldehyde: 0.06% by weight), which contained a monomer having a weight average molecular weight of 690 with a range of molecular weight of 90 to 190 and a polymer having a range of molecular weight of 200 to 2,000 at a weight ratio of 3:97, was used; thus, a kenaf fiber board was prepared.

By using the above-mentioned kenaf fiber boards formed in examples 6 to 14, tests were carried out with respect to the expansion coefficient in water-absorption thickness and peel strength in accordance with methods standardized in JIS A 5905 (fiber board). Table 4 shows the results.

TABLE 4

| | Mat moisture content prior to resin impregnation | Average molecular weight of adhesive agent | Rate of monomer and polymer | Polymer components: Monomer component Molecular weight range | Polymer components: having polymerization degree of 2 or more Molecular weight range | Total resin weight ratio | Board physical properties: Expansion coefficient in water-absorption thickness (%) | Board physical properties: Peel strength (Mpa) |
|---|---|---|---|---|---|---|---|---|
| Example 6 | 25% | 498 | 40:60 | 90 to 190 | 200 to 2000 | 25.0% | 6.7 | 2.2 |
| Example 7 | | 560 | 30:70 | | | | 6.9 | 2.5 |
| Example 8 | | 640 | 20:80 | | | | 7.3 | 2.7 |
| Example 9 | 13% | 640 | 20:80 | | | | 6.6 | 2.7 |
| Example 10 | 25% | 360 | 0:100 | — | 200 to 650 | 25.0% | 18.5 | 0.4 |
| Example 11 | | 605 | 0:100 | — | 200 to 1000 | | 15.3 | 1.8 |
| Example 12 | | 1010 | 0:100 | — | 200 to 2000 | | 22.5 | 2.9 |
| Example 13 | | 450 | 60:40 | 90 to 190 | 200 to 1000 | | 12.8 | 1.2 |
| Example 14 | | 690 | 3:97 | | 200 to 2000 | | 12.9 | 1.6 |

As indicated by Table 4, it is confirmed that any of the fiber boards shown in examples 6 to 9 have a small expansion coefficient in water-absorption thickness, are superior in dimension stability and also have high peel strength.

Comparative Examples 4 and 5

Fiber boards were prepared in a manner similar to Example 1 to have the board density of 600 kg/m$^3$ and 800 kg/m$^3$ respectively, except that oil palm fibers having an average length of 35 mm and an average diameter of 480 μm were used instead of kenaf fibers.

The bending strength and Young's modulus in flexure were measured. The results are shown in Table 5 together with the results of the kenaf fiber board of Examples 1 and 3.

TABLE 5

| | Density (kg/m$^3$) | Bending strength (MPa) | Young's modulus in flexure (GPa) |
|---|---|---|---|
| Comparative Example 4 | 600 | 15 | 1.0 |
| Comparative Example 5 | 800 | 35 | 2.6 |
| Example 1 | 600 | 48 | 3.0 |
| Example 3 | 800 | 88 | 8.6 |

INDUSTRIAL APPLICABILITY

Since a fiber board of the present invention is excellent in strength as well as moisture permeability, the fiber board can be utilized as a wall material for forming walls in a house and the like, and also utilized as construction materials, such as floor materials, ceiling materials and grounding materials.

What is claimed is:

1. A fiber board manufactured by bonding kenaf fibers obtained by fiber-opening kenaf with a thermosetting adhesive agent, wherein the kenaf fibers having an average length of 10 to 200 mm with an average diameter being set in a range of 10 to 300 μm are used, and a fiber mat formed by aggregating the kenaf fibers is impregnated with the thermosetting adhesive agent so that the fiber board is formed so as to have a density of 600 to 900 kg/m$^3$, the thermosetting adhesive agent is a phenolic resin having an average molecular weight of 400 to 700, which contains 10 to 40% by weight of a monomer and 60 to 90% by weight of a polymer having a molecular weight of 200 to 2,000, and the pH of the thermosetting adhesive agent is set to not more than 10.

2. The fiber board according to claim 1, wherein the kenaf fibers have a standard deviation in length of not more than 20 mm and a standard deviation in diameter of not more than 50 μm.

3. A fiber board, comprising:

kenaf fibers having an average length of 10 to 200 mm and an average diameter of 10 to 300 μm, and a cured thermosetting adhesive agent, wherein the thermosetting adhesive agent is a phenolic resin having an average molecular weight of 400 to 700, which contains 10 to 40% by weight of a monomer and 60 to 90% by weight of a polymer having a molecular weight of 200 to 2,000, the pH of the thermosetting adhesive agent is set to not more than 10, and the fiber board has a density of 600 to 900 kg/m$^3$.

4. The fiber board according to claim 3, wherein the fibers have a standard deviation in length of not more than 20 mm and a standard deviation in diameter of not more than 50 μm.

5. The fiber board according to claim 3, wherein a moisture permeation resistance of the board is 5,400 (m$^2$.s.Pa)/ng or less in accordance with JIS A 5905.

6. The fiber board according to claim 3, wherein a bending strength is at least 44 MPa in accordance with JIS A 5905.

7. The fiber board according to claim 3, wherein a peel strength is at least 0.5 MPa in accordance with JIS A 5905.

* * * * *